US010072666B2

(12) United States Patent
Ohnishi

(10) Patent No.: US 10,072,666 B2
(45) Date of Patent: Sep. 11, 2018

(54) HERMETIC COMPRESSOR DRIVING DEVICE

(71) Applicant: Mitsubishi Electric Corporation, Tokyo (JP)

(72) Inventor: Takamasa Ohnishi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 454 days.

(21) Appl. No.: 14/723,510

(22) Filed: May 28, 2015

(65) Prior Publication Data

US 2015/0354579 A1 Dec. 10, 2015

(30) Foreign Application Priority Data

Jun. 4, 2014 (JP) ..... 2014-116183

(51) Int. Cl.
*F04D 27/00* (2006.01)
*F04B 49/06* (2006.01)
(Continued)

(52) U.S. Cl.
CPC ..... *F04D 27/001* (2013.01); *F04B 49/06* (2013.01); *F04B 49/065* (2013.01); *F04D 25/06* (2013.01); *F04D 29/40* (2013.01)

(58) Field of Classification Search
CPC ..... F04B 53/006; F04B 53/147; F04B 53/16; F04B 1/04; F04B 1/128; F04B 17/03;
(Continued)

(56) References Cited

U.S. PATENT DOCUMENTS 2,924,297 A * 2/1960 Brandon ..... B66B 5/028 187/275
3,585,451 A * 6/1971 Day, III ..... H02H 3/025 361/22
(Continued)

FOREIGN PATENT DOCUMENTS

JP 10-122155 A 5/1998
JP 2009-156236 A 7/2009
(Continued)

OTHER PUBLICATIONS

Office Action dated Nov. 20, 2015 in the corresponding AU application No. 2015202553.

*Primary Examiner* — Devon Kramer
*Assistant Examiner* — Christopher Brunjes
(74) *Attorney, Agent, or Firm* — Posz Law Group, PLC

(57) ABSTRACT

A hermetic compressor driving device, which drives a hermetic compressor provided with an HPS (High Pressure Switch) therein, includes parameter detection units (a voltage detection unit, an overcurrent detection unit, and a position and open-phase detection unit) that detect an overcurrent, a bus voltage, and an open phase, which are generated during the opening operation of the HPS within the hermetic compressor; a temperature detection unit that detects the temperature of the hermetic compressor; and a control unit to which data acquired by the parameter detection units and the temperature detection unit is input. When detecting an abnormality on the basis of the data and upon determining the abnormality as a resumable abnormality, the control unit outputs a drive signal; and, upon determining the abnormality as being not a resumable abnormality, outputs an abnormality signal so as to stop the driving of the hermetic compressor.

6 Claims, 3 Drawing Sheets

(51) Int. Cl.
*F04D 29/40* (2006.01)
*F04D 25/06* (2006.01)

(58) Field of Classification Search
CPC .... F04B 9/02; F04B 9/04; F04B 9/042; F04B 9/045; F04B 9/047; F04B 35/01; F04B 27/004; F04B 27/008; F04B 2203/0201; F04B 2203/0202; F04B 2203/0205
See application file for complete search history.

(56) References Cited

U.S. PATENT DOCUMENTS

| | | | |
|---|---|---|---|
| 2003/0117753 | A1 | 6/2003 | Kato et al. |
| 2015/0214863 | A1 | 7/2015 | Sumi et al. |

FOREIGN PATENT DOCUMENTS

| | | | | |
|---|---|---|---|---|
| JP | 5005449 | B2 | 6/2012 | |
| JP | 5031547 | B2 | 7/2012 | |
| WO | 2014/010225 | A1 | 1/2014 | |
| WO | WO 2014010225 | A1 * | 1/2014 | ..... F04B 35/04 |

* cited by examiner

HERMETIC COMPRESSOR DRIVING DEVICE

BACKGROUND OF THE INVENTION

1. Field of the Invention

The present invention relates to a hermetic compressor driving device.

2. Description of the Related Art

A conventional driving device for a hermetic compressor including a motor and a compression mechanism unit is exemplified by a driving device that converts an alternating current of a commercial alternating-current power supply into a direct current; uses a switching circuit to convert the converted direct current into a three-phase pseudo alternating current; and then applies the three-phase pseudo alternating current to the respective phase windings of the motor. In such a driving device, in order to sequentially switch a plurality of phase windings that are connected from the switching circuit to these phase windings, voltages induced in phase windings in a nonconductive state among these phase windings are detected; the rotor position of the motor is detected by using the detected voltages; and the switching timing of the switching circuit is controlled according to the detected position. Such a driving device includes a normally open contact that is closed when the pressure or temperature in a hermetic case (a hermetic compressor) abnormally increases and a current limiting element that is directly connected to the normally open contact. In this driving device, when the pressure or temperature abnormally increases, any of two unconnected phase windings among the respective phase windings are connected to each other; an overload current in a current flowing via the current limiting element is detected; and then the switching operation of the inverter is stopped, thereby preventing the pressure or temperature of the hermetic compressor from abnormally increasing.

For example, Japanese Patent Application Laid-open No. 2009-156236 discloses a compressor driving device in which, when the pressure in a hermetic compressor abnormally increases, a normally open contact and a current limiting element included in a protection device in the hermetic compressor are activated so that the compressing operation of the hermetic compressor is stopped, thereby controlling the pressure in the hermetic compressor so as not to increase more than a predetermined value. Japanese Patent Application Laid-open No. 2009-156236 also discloses a technique in which, when the normally open contact of the compressor driving device is operated, as the current limiting element in the hermetic compressor is connected with the windings, a short path passing through a switching element and the current limiting element is formed between bus voltages.

However, according to the conventional technique described above, even when a refrigerant load is temporarily increased, the normally open contact is operated in accordance with the pressure increase in the hermetic compressor, and thus an overload current flows through a switching element of the switching circuit via the current limiting element. Therefore, a case occurs where the current limiting element within the hermetic compressor and the switching element of the switching circuit are damaged. As a result, with the conventional technique, there is a problem in that, although a temporal increase of a refrigerant load is the cause of the pressure increase, a circuit board or the hermetic compressor still needs to be replaced or repaired.

When a hermetic compressor having an HPS (High Pressure Switch) incorporated therein is used to stop operations safely, phase windings are opened when the pressure within the hermetic compressor reaches a predetermined value or more. Therefore, even when the pressure increase is due to a temporal increase in the refrigerant load, there is a problem in that the pressure within the hermetic compressor is increased and the HPS does not operate in a desirable way.

SUMMARY OF THE INVENTION

It is an object of the present invention to at least partially solve the problems with the conventional technology.

The present invention relates to a hermetic compressor driving device that drives a hermetic compressor provided with a high pressure switch therein. The hermetic compressor driving device includes: a parameter detection unit that detects an overcurrent, a bus voltage, and an open phase that are generated when an opening operation of the high pressure switch provided within the hermetic compressor is performed; a temperature detection unit that detects a temperature of the hermetic compressor; and a control unit to which data acquired by the parameter detection unit and the temperature detection unit is input. The control unit, when detecting an abnormality on the basis of the data, determines whether or not the abnormality is a resumable abnormality, when determining that the abnormality is a resumable abnormality, outputs a drive signal again, and when determining that the abnormality is not a resumable abnormality, outputs an abnormality signal so as to stop the driving of the hermetic compressor.

The above and other objects, features, advantages and technical and industrial significance of this invention will be better understood by reading, and considering in connection with the accompanying drawings, the following detailed description of presently preferred embodiments of the invention.

DETAILED DESCRIPTION OF THE PREFERRED EMBODIMENTS

Exemplary embodiments of a hermetic compressor driving device according to the present invention will be described below in detail with reference to the accompanying drawings. The present invention is not limited to the embodiments.

Embodiment

Figure 1:
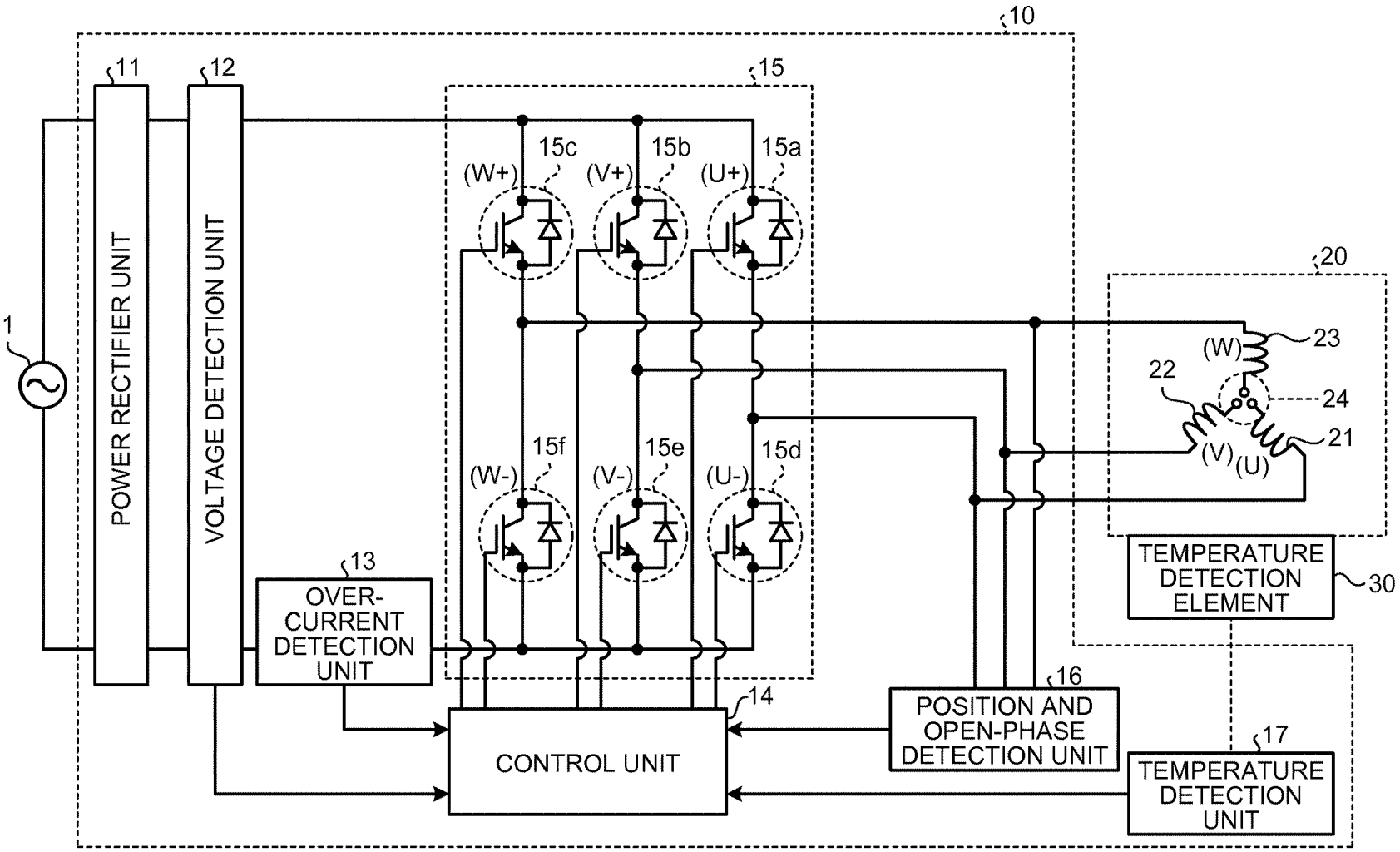
FIG. 1 is a diagram illustrating an example of a configuration of a hermetic compressor driving device according to an embodiment of the present invention.

FIG. 1 is a diagram illustrating an example of a configuration of a hermetic compressor driving device according to an embodiment of the present invention. A hermetic compressor driving device 10, connected to a commercial alternating-current power supply 1, drives a hermetic compressor 20.

The hermetic compressor 20 includes phase windings 21, 22, and 23 and a High Pressure Switch (HPS) 24. The hermetic compressor 20 has a mechanism in which, when the pressure in the hermetic compressor 20 becomes larger than a predetermined value (a threshold), the HPS 24 mechanically opens any one phase of or all three phases of the phase windings 21, 22, and 23, and the compressing operation of the hermetic compressor 20 is mechanically stopped; and then, when the pressure again becomes less than the predetermined value (the threshold), the phase windings 21, 22, and 23 are reconnected and driving of the hermetic compressor 20 can be resumed. Here, the predetermined value (the threshold) can be a constant value, or it can be a value that varies with hysteresis.

The hermetic compressor driving device 10 includes a power rectifier unit 11, a voltage detection unit 12, an overcurrent detection unit 13, a control unit 14, a switching circuit 15, and a position and open-phase detection unit 16. The power rectifier unit 11 is a rectifier that converts an alternating current of the commercial alternating-current power supply 1 into a direct current. The voltage converted into a direct current is applied to the switching circuit 15 via the voltage detection unit 12 and the overcurrent detection unit 13. The voltage detection unit 12 detects a voltage between buses and outputs the detected voltage to the control unit 14. The overcurrent detection unit 13 detects a current flowing in the switching circuit 15 and outputs the detected current to the control unit 14.

The switching circuit 15 includes switching elements 15*a*(U+), 15*b*(V+), 15*c*(W+), 15*d*(U−), 15*e*(V−), and 15*f* (W−); converts a direct-current voltage that is input thereto into a three-phase pseudo alternating-current voltage; and outputs the converted voltage. The phase winding 21 is connected between the switching elements 15*a*(U+) and 15*d*(U−); the phase winding 22 is connected between the switching elements 15*b*(V+) and 15*e*(V−); and the phase winding 23 is connected between the switching elements 15*c*(W+) and 15*f*(W−).

The position and open-phase detection unit 16 is connected to a conduction line disposed between the switching circuit 15 and the hermetic compressor 20. The position and open-phase detection unit 16 detects voltages induced in phase windings in a nonconductive state among the phase windings 21, 22, and 23; detects, depending on the detected voltages, the rotation position of a rotor within the hermetic compressor 20; and outputs the detected rotation position of the rotor to the control unit 14.

A temperature detection element 30 is connected to (the outside of) the hermetic compressor 20; and a temperature detection unit 17 detects the temperature of the hermetic compressor 20 using the temperature detection element 30, and the detected temperature is output to the control unit 14. The power rectifier unit 11, the control unit 14, the switching circuit 15, and the position and open-phase detection unit 16 constitute an inverter that supplies a drive voltage to the phase windings 21, 22, and 23 of the hermetic compressor 20.

The control unit 14 supplies a drive signal for controlling the switching ON and OFF of at least the switching elements 15*a* to 15*f* that are included in the switching circuit 15, and it stops the supply of the drive signal to the switching elements 15*a* to 15*f* when an abnormality is detected. The drive signal is generated according to detection results of respective detection units input to the control unit 14. Here, examples of the time of detecting an abnormality include the time when an open phase was detected by the position and open-phase detection unit 16; a time when an abnormality in a bus voltage was detected by the voltage detection unit 12; or a time when an overcurrent was detected by the overcurrent detection unit 13.

As described above, when there is an abnormality in which the pressure in the hermetic compressor 20 is larger than a predetermined value (a threshold), the HPS 24 is operated and the compressing operation of the hermetic compressor 20 is mechanically stopped. Exemplifications of when the HPS 24 is operating in this way can be a case in which an open phase in a compressor winding occurs (when detecting an open phase), a case in which an abnormality in a bus voltage occurs (when detecting an abnormality in a bus voltage), or a case in which an abnormality in a compressor drive current occurs (when detecting an overcurrent).

The position and open-phase detection unit 16 detects, by using a current sensor (not illustrated), a current flowing in the phase windings 21, 22, and 23 when the switching elements 15*a* to 15*f* of the switching circuit 15 are driven. The control unit 14 determines the position and the open phase according to the current detected by the current sensor. When the HPS 24 is operated, the phase windings 21, 22, and 23 are opened, and thus no current flows in the phase windings 21, 22, and 23 even when the switching elements 15*a* to 15*f* are driven (for example, a current of 0 amperes is output from the position and open-phase detection unit 16). Accordingly, it is determined that an open phase abnormality has occurred.

The control unit 14 monitors the value of a bus voltage output from the voltage detection unit 12; and when the value of the bus voltage is not within a predetermined range, it is determined that a bus voltage abnormality has occurred.

The overcurrent detection unit 13 monitors the current flowing in the switching circuit 15 that operates as an inverter; and when the current exceeds a predetermined value, the overcurrent detection unit 13 outputs a signal to the control unit 14 and the control unit 14 determines that an overcurrent abnormality has occurred.

Figure 2A:
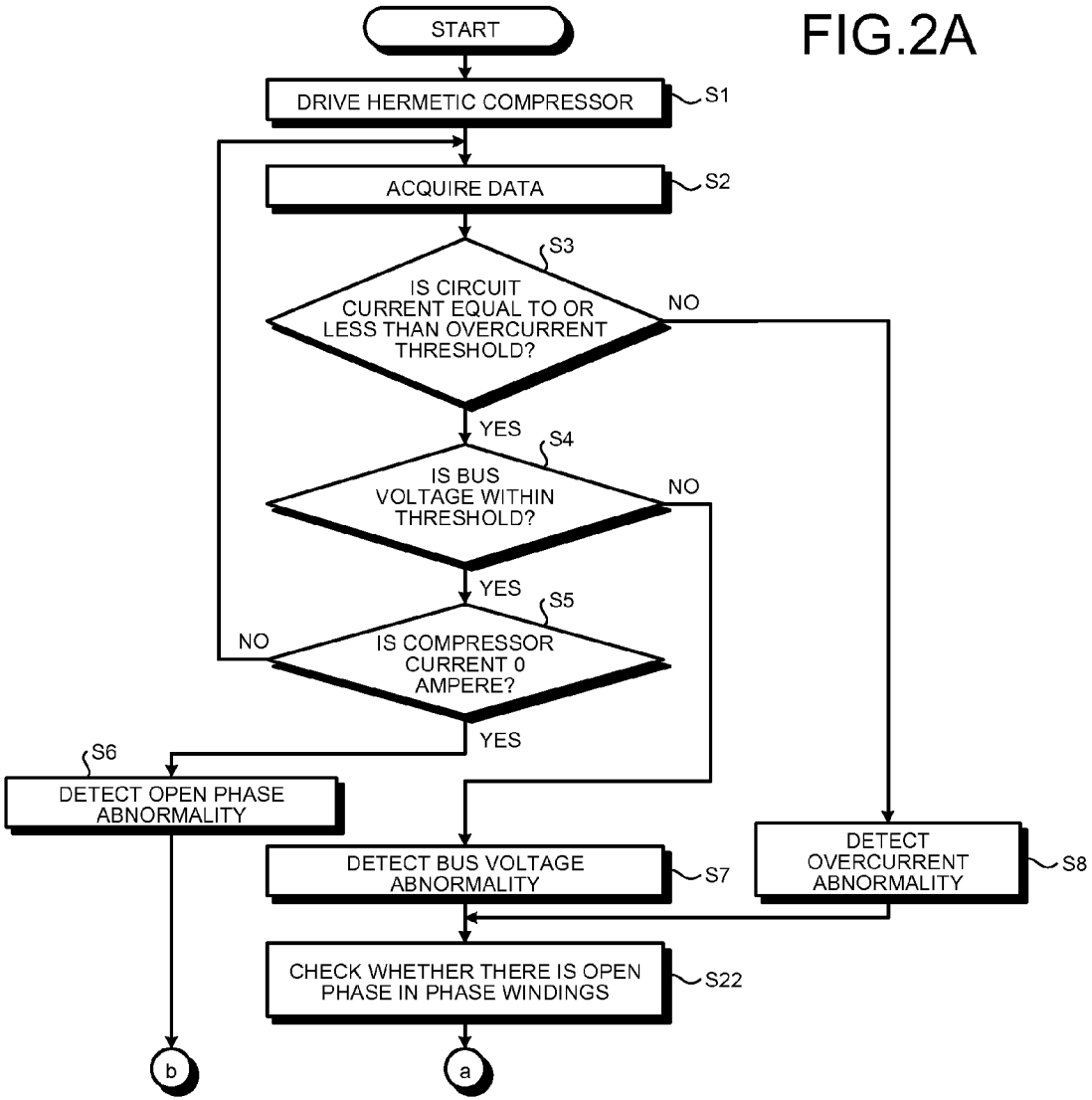
FIGS. 2A and 2B are a flowchart showing an example of the control performed when detecting an abnormality in the hermetic compressor driving device according to the embodiment.
Figure 2B:
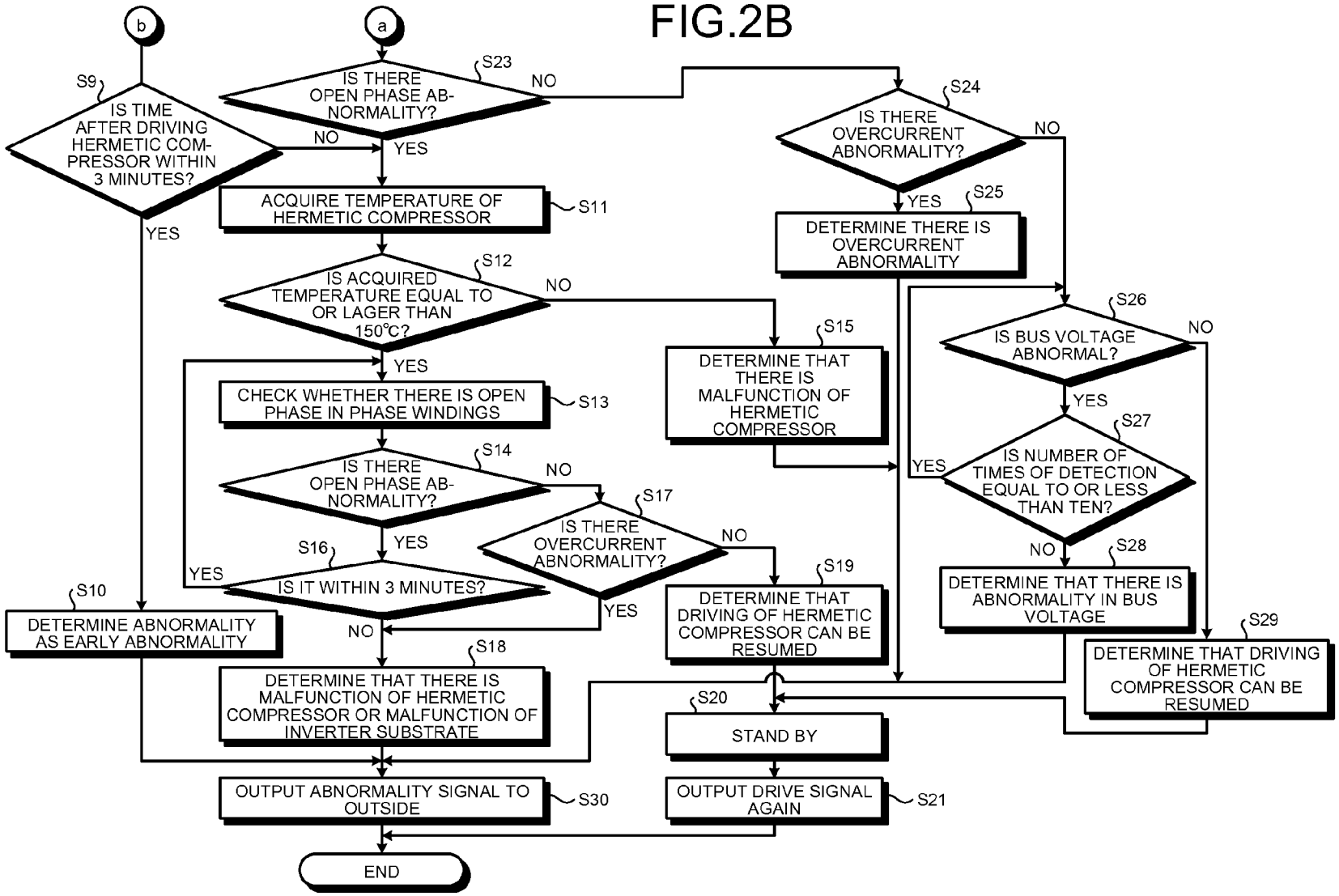

FIG. 2 is a flowchart illustrating an example of the control performed when detecting an abnormality in the hermetic compressor driving device according to the embodiment of the present invention. First, the process starts to cause the hermetic compressor driving device 10 to drive the hermetic compressor 20 (Step S1). After driving the hermetic compressor 20, the control unit 14 acquires data (such as data indicating positions and any open phases, currents, voltages, and currents flowing in the phase windings 21, 22, and 23) from the voltage detection unit 12, the overcurrent detection unit 13, and the position and open-phase detection unit 16 (Step S2).

Subsequently, the control unit 14 determines whether a current (a circuit current) flowing in the switching circuit 15 is equal to or less than an overcurrent threshold (Step S3). As a result of the determination at Step S3, when it is determined that the current (the circuit current) flowing in the switching circuit 15 is equal to or less than the overcurrent threshold (YES at Step S3), the control unit 14 determines whether a bus voltage is within a threshold (including the case where the bus voltage is equal to the threshold) (Step S4). When, as a result of the determination at Step S3, it is determined that the current (the circuit current) flowing in the switching circuit 15 is not equal to or less than the overcurrent threshold (NO at Step S3), the control unit 14 detects an overcurrent abnormality (Step S8).

When, as a result of the determination at Step S4, it is determined that the bus voltage is within the threshold (YES at Step S4), the control unit 14 determines whether a compressor current (a current flowing in the phase windings 21, 22, and 23) is 0 amperes (Step S5). When, as a result of the determination at Step S4, it is determined that the bus voltage is not within the threshold (NO at Step S4), the control unit 14 detects a bus voltage abnormality (Step S7).

When, as a result of the determination at Step S5, it is determined that the compressor current (the current flowing in the phase wirings 21, 22, and 23) is 0 amperes (YES at Step S5), the control unit 14 detects an open phase abnormality (Step S6). When, as a result of the determination at Step S5, it is determined that the compressor current (the current flowing in the phase wirings 21, 22, and 23) is not 0 amperes (NO at Step S5), the process returns to Step S2 and data acquisition is performed.

Note that the order of the determinations at Steps S3, S4, and S5 is not limited to the above example. That is, the determinations can be performed with the following orders of Steps: Steps S3, S5, and S4, Steps S4, S3, and S5, Steps S4, S5, and S3, Steps S5, S3, and S4, or Steps S5, S4, and S3.

When an open phase abnormality is detected (Step S6), assumed problems include, for example, disconnection of the phase windings 21, 22, and 23 of the hermetic compressor 20; disconnection of wirings in the hermetic compressor driving device 10; a malfunction of the hermetic compressor 20; a malfunction of an inverter substrate of the hermetic compressor driving device 10; and an undesirable operation of the HPS 24. If the open phase abnormality is assumed to be due to an operation of the HPS 24 and if the open phase abnormality is caused by a pressure increase of the hermetic compressor 20 due to a temporal refrigerant increase, it is not a malfunction; therefore any repairing or replacing work is not necessary. In this manner, in a case where any repairing or replacing work is not necessary, driving of the hermetic compressor 20 can be resumed.

When an open phase abnormality is detected (Step S6), the control unit 14 determines whether the time after starting the driving of the hermetic compressor 20 (Step S1) is equal to or less than a predetermined time (a threshold time) (Step S9). In this case, the threshold time is 3 minutes, for example. As a result of the determination at Step S9, when it is determined that the time after starting the driving (activating) of the hermetic compressor 20 is equal to or less than the threshold time (3 minutes, for example) (when YES at Step S9), the control unit 14 determines that there is an early abnormality (faulty wiring or disconnection) (Step S10); and in order not to resume the driving of the hermetic compressor 20, the control unit 14 outputs an abnormality signal to an external destination (Step S30), and the process is ended. Due to the output of the abnormality signal, a user recognizes the presence of an abnormality and handles the abnormality by repairing, replacement, and the like.

As a result of the determination at Step S9, when it is determined that the time after starting the driving (activating) of the hermetic compressor 20 is not within the threshold time (3 minutes, for example) (NO at Step S9), the cause of the open phase abnormality is not an early abnormality; and it is assumed that the cause is a malfunction of the hermetic compressor 20 during driving or an operation of the HPS 24. In this case, when the HPS 24 is operated, the pressure in the hermetic compressor 20 becomes high and the temperature of the hermetic compressor 20 also becomes high. The temperature detection unit 17 acquires the temperature of the hermetic compressor 20 by the temperature detection element 30 and transmits the acquired temperature to the control unit (Step S11); and then the control unit 14 determines whether the acquired temperature of the hermetic compressor 20 is equal to or larger than a temperature threshold (Step S12). In this case, the temperature threshold of the hermetic compressor 20 is 150° C., for example.

As a result of the determination at Step S12, when it is determined that the temperature of the hermetic compressor 20 is equal to or higher than the temperature threshold (150° C.) (YES at Step S12), the position and open-phase detection unit 16 determines whether there is any open phase in the phase windings 21, 22, and 23 (Step S13); and the control unit 14 determines whether there is any open phase abnormality (Step S14). When the temperature of the hermetic compressor 20 is less than the temperature threshold (NO at Step S12), the control unit 14 determines that there is a malfunction of the hermetic compressor 20 (Step S15), and it outputs an abnormality signal to an external destination (Step S30). Due to the output of the abnormality signal, the user recognizes the presence of an abnormality and handles the abnormality by repairing, replacement, and the like.

When, as a result of the determination at Step S14, it is determined that there is an open phase abnormality (YES at Step S14), the control unit 14 determines whether the time after starting the driving (activating) of the hermetic compressor 20 is equal to or less than a predetermined time (a threshold time of 3 minutes) (Step S16). When, as a result of the determination at Step S16, it is determined that the time after starting the driving (activating) of the hermetic compressor 20 is within the predetermined time (the threshold time of 3 minutes) (YES at Step S16), the position and open-phase detection unit 16 checks again as to whether there is any open phase in the phase wirings 21, 22, and 23 (Step S13). This operation means that, until the phase open state is cancelled or until the predetermined time (the threshold time of 3 minutes) elapses after starting the driving (activating) of the hermetic compressor 20, the operation is repeated to check whether there is any open phase in the phase wirings 21, 22, and 23 (Step S13); to determine whether there is any open phase abnormality (Step S14); and to check whether the determination of the time after starting the driving of the hermetic compressor 20 is equal to or less than the threshold (3 minutes) (Step S16).

When, as a result of the determination at Step S14, the process branches to NO, the control unit 14 determines whether any overcurrent abnormality is detected in the overcurrent detection unit 13 (Step S17). When, as a result of the determination at Step S17, it is determined that an overcurrent abnormality is detected (YES at Step S17), the control unit 14 determines that there is a malfunction of the hermetic compressor 20 or a malfunction of an inverter substrate (Step S18), and it outputs an abnormality signal to an outside destination (Step S30). Upon the output of the abnormality signal, the user recognizes an abnormality and handles the abnormality by repairing, replacement, and the like. When, as a result of the determination at Step S17, it is determined that no overcurrent abnormality is detected (NO at Step S17), it is assumed that the pressure in the hermetic compressor 20 has increased due to a temporal refrigerant increase and the HPS is operated; and then the control unit 14 determines that driving of the hermetic compressor 20 can be resumed (Step S19), stands by for a predetermined time (3 minutes, for example) (Step S20), and outputs a drive signal again (Step S21).

Although not illustrated, it is also possible to perform a process of counting the number of times an abnormality [is detected/detection is performed?] in a specified time (30 minutes, for example) after activating the hermetic compressor 20, and when the counted number exceeds a preset number (three times, for example), it is determined as a malfunction of the hermetic compressor 20 and an abnormality signal is output to an external destination; and when the counted number within the specified time (30 minutes, for example) has not exceeded the preset number (three times, for example), the counted number is reset. Because there is a possibility of faulty wiring and the like occurring before the elapsing of a threshold time after activating the hermetic compressor 20, an abnormality signal is output to an external destination (Step S30).

Meanwhile, when the process branches to NO (Step S7) as a result of the determination at Step S4, or when the process branches to NO (Step S8) as a result of the determination at Step S3, in order to check whether the phase windings 21, 22, and 23 are in a nonconductive state due to an operation of the HPS 24, the position and open-phase detection unit 16 checks whether there are any open phases in the phase windings 21, 22, and 23 (Step S22); and the control unit 14 determines whether there is any open phase abnormality (Step S23). When, as a result of the determination at Step S23, it is determined that there is an open phase abnormality (YES at Step S23), the process proceeds to Step S11, and subsequent processes are the same as those described above. As a result of the determination at Step S23, when it is determined that there is no open phase abnormality (NO at Step S23), the control unit 14 determines whether there is any overcurrent abnormality (Step S24). When, as a result of the determination at Step S24, the process branches to YES, the control unit 14 determines that there is an overcurrent abnormality (Step S25), and outputs an abnormality signal to an external destination (Step S30).

When, as a result of the determination at Step S24, the process branches to NO, there is a high possibility that the hermetic compressor 20 has been affected by fluctuations of the commercial alternating-current power supply 1; and thus the control unit 14 determines whether the bus voltage is abnormal (Step S26). When, as a result of the determination at Step S26, the process branches to YES, the control unit 14 determines whether the number of detections (abnormality detections) is equal to or less than a preset number of times (ten times, for example) (Step S27). When, as a result of the determination at Step S27, it is determined that the number of detections is equal to or less than the preset number of times (ten times, for example) (YES at Step S27), it is again determined whether the bus voltage is abnormal (Step S26). When, as a result of the determination at Step S27, it is determined that the number of detections exceeds the preset number of times (ten times, for example) (NO at Step S27), the control unit 14 determines that there is an abnormality in the bus voltage (Step S28) and outputs an abnormality signal to an external destination (Step S30).

When, as a result of the determination at Step S26, the process branches to NO, that is, when the determination has ended before the number of detections reaches a preset number of times (NO at Step S26 after YES at Step S27), the control unit 14 determines that driving of the hermetic compressor 20 can be resumed (Step S29), stands by for a predetermined time (a threshold time of 3 minutes) (Step S20), and outputs a drive signal again (Step S21).

Although not illustrated, also in this case, it is possible to perform a process in which the number of abnormality detections in a specified time (30 minutes, for example) after activating the hermetic compressor 20 is counted, and when the counted number exceeds a preset number (three times, for example), it is determined there is a malfunction of the hermetic compressor 20 and an abnormality signal is output to an external destination; and when the counted number within the specified time (30 minutes, for example) has not exceeded the preset number (three times, for example), the counted number is reset. Because there is a possibility of faulty wiring and the like occurring before the elapsing of a threshold time after activating the hermetic compressor 20, an abnormality signal is output to an external destination (Step S30).

As described above, according to the above embodiment, when there is an abnormality, it is possible, for example, to determine whether either it is an abnormality that is caused by a temporal increase of a refrigerant load and it is thus an abnormality that allows driving of the hermetic compressor to be resumed or it is an abnormality that requires repair or replacement. While the hermetic compressor driving device described in the present embodiment is suitable for an air conditioner, the application of the present invention is not limited thereto, and the invention can be also applied to other types of devices that are connected to an alternating-current power supply and include a hermetic compressor.

The present invention is not limited to the configurations described in the above embodiment; and additions, modifications, and omissions to or from the configuration can be made without departing from the scope of the invention.

According to the present invention, it is possible to obtain a hermetic compressor driving device that determines whether an operation of an HPS is due to a pressure increase caused by a temporal increase of a refrigerant load; and that, if it is a pressure increase caused by a temporal increase of a refrigerant load, can resume the driving of a hermetic compressor.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A hermetic compressor driving device that drives a hermetic compressor provided with a high pressure switch therein, the hermetic compressor driving device comprising:

a parameter detection unit that detects an overcurrent as overcurrent detection data, a bus voltage, and an open phase as current detection data, that are generated when an opening operation of the high pressure switch provided within the hermetic compressor is performed;

a temperature detection unit that detects a temperature of the hermetic compressor; and a control unit configured to input data, including the overcurrent detection data, the bus voltage, and the current detection data acquired by the parameter detection unit and the temperature detected by the temperature detection unit, wherein the control unit is further configured to, when detecting an abnormality on the basis of the data, determine whether or not the abnormality is a resumable abnormality, wherein the resumable abnormality means that repair or replacement work is not necessary to solve the abnormality, and the resumable abnormality is an open phase abnormality caused by a temporal refrigerant load, responsive to determining that the abnormality, which is detected, is a resumable abnormality, output a drive signal again to the hermetic compressor despite the abnormality continuing to be detected, and responsive to determining that the abnormality, which is detected, is not a resumable abnormality, output an abnormality signal so as to stop the driving of the hermetic compressor.

2. The hermetic compressor driving device according to claim 1, wherein the high pressure switch in the hermetic compressor detects pressure and opens a phase which is detected by the parameter detection unit as the current detection data and provided to the control unit for detecting the abnormality.

3. The hermetic compressor driving device according to claim 1, wherein the control unit is further configured to:

responsive to determining that the abnormality is detected, which is the resumable abnormality, prior to outputting the drive signal again, stand by for a predetermined time.

4. A hermetic compressor driving device that drives a hermetic compressor provided with a high pressure switch therein, the hermetic compressor driving device comprising:

a parameter detection unit that detects an overcurrent as overcurrent detection data, a bus voltage, and an open phase as current detection data, that are generated when an opening operation of the high pressure switch provided within the hermetic compressor is performed;

a temperature detection unit that detects a temperature of the hermetic compressor; and a control unit configured to input data, including the overcurrent detection data, the bus voltage, and the current detection data acquired by the parameter detection unit and the temperature detected by the temperature detection unit, wherein the control unit is further configured to, when detecting an abnormality on the basis of the data, determine whether or not the abnormality is a resumable abnormality, wherein the resumable abnormality means that repair or replacement work is not necessary to solve the abnormality, and the resumable abnormality is an open phase abnormality caused by a temporal increase of a refrigerant load, responsive to determining that the abnormality, which is detected, is a resumable abnormality, output a drive signal again to the hermetic compressor despite the abnormality continuing to be detected, and responsive to determining that the abnormality, which is detected, is not a resumable abnormality, output an abnormality signal so as to stop the driving of the hermetic compressor.

5. The hermetic compressor driving device according to claim 4, wherein the high pressure switch in the hermetic compressor detects pressure and opens a phase which is detected by the parameter detection unit as the current detection data and provided to the control unit for detecting the abnormality.

6. The hermetic compressor driving device according to claim 4, wherein the control unit is further configured to:

responsive to determining that the abnormality is detected, which is the resumable abnormality, prior to outputting the drive signal again, stand by for a predetermined threshold time.

* * * * *